United States Patent [19]

Ohotsubo

[11] 3,960,920

[45] June 1, 1976

[54] PROCESS FOR THE PREPARATION OF A SATURATED POLYCYCLIC CARBOXYLIC ACID

[75] Inventor: Junichirow Ohotsubo, Izumi, Japan

[73] Assignee: Nard Institute, Ltd., Osaka, Japan

[22] Filed: Feb. 13, 1975

[21] Appl. No.: 549,798

[30] Foreign Application Priority Data

Feb. 15, 1974 Japan ..... 49-18983

[52] U.S. Cl. ..... 260/464; 260/468 G; 260/514 G

[51] Int. Cl.[2] ..... C07C 120/00; C07C 121/46

[58] Field of Search ..... 260/464

[56] References Cited

UNITED STATES PATENTS

| | | | |
|---|---|---|---|
| 2,635,979 | 4/1953 | Lidov | 260/464 X |
| 3,173,939 | 3/1965 | Johnson | 260/465.4 |
| 3,350,439 | 10/1967 | Feldman et al. | 260/465.5 R |

OTHER PUBLICATIONS

Degering, "An Outline of Organic Nitrogen Compounds", 1945, p. 508.

*Primary Examiner*—Joseph Paul Brust

*Attorney, Agent, or Firm*—Wenderoth, Lind & Ponack

[57] ABSTRACT

A saturated polycyclic carboxylic acid of the general formula:

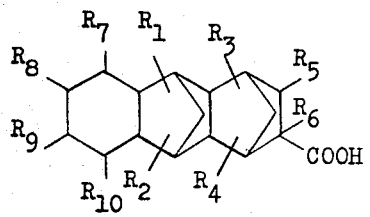

wherein $R_1$, $R_2$, $R_3$, $R_4$, $R_5$, $R_6$, $R_7$, $R_8$, $R_9$, and $R_{10}$, are each hydrogen or methyl, or its water soluble salt, which is useful as a sizing agent for paper manufacture, is prepared from an unsaturated polycylic nitrile compound of the general formula:

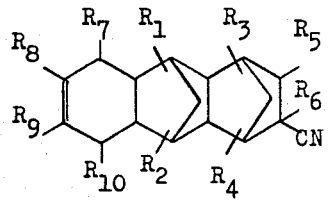

2 Claims, No Drawings

PROCESS FOR THE PREPARATION OF A SATURATED POLYCYCLIC CARBOXYLIC ACID

The present invention relates to a process for the preparation of a polycyclic carboxylic acid or its water soluble salt which is useful as a sizing agent for paper manufacture.

The present invention also relates to a new saturated polycyclic nitrile compound which is a key intermediate for preparing the said saturated polycyclic carboxylic acid or its water soluble salt.

The saturated polycyclic carboxylic acid or its water soluble salt possessing excellent sizing effect may be represented by the following general formula:

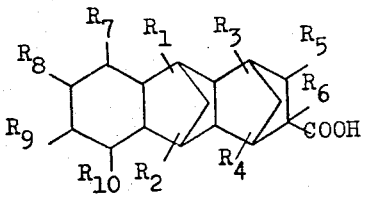

(I)

wherein $R_1$, $R_2$, $R_3$, $R_4$, $R_5$, $R_6$, $R_7$, $R_8$, $R_9$, and $R_{10}$ are each hydrogen or methyl, or its water soluble salt.

The saturated polycyclic carboxylic acid (I) or its water soluble salt can be prepared industrially and economically by hydrogenating a unsaturated polycyclic nitrile compound of the general formula:

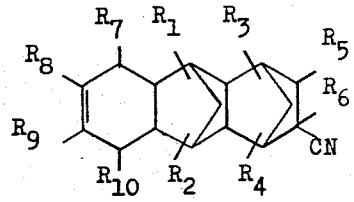

(II)

wherein $R_1$, $R_2$, $R_3$, $R_4$, $R_5$, $R_6$, $R_7$ , $B_8$, $R_9$, and $R_{10}$ are each as defined above, in the presence of a noble metal for catalytic reduction with alcohol or without any solvent to produce a saturated polycyclic nitrile compound of the general formula:

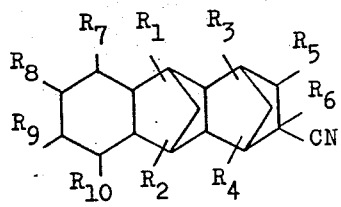

(III)

wherein $R_1$, $R_2$, $R_3$, $R_4$, $R_5$, $R_6$, $R_7$, $R_8$, $R_9$, and $R_{10}$ are each as defined above, and then saponifying the resulting compound with an alkali or hydrolyzing.

As a sizing agent for paper manufacture, rosin is used since old times and recently fortified rosin sizing agent, which is prepared by subjecting a part of the rosin to an addition reaction with maleic acid or fumaric acid and then the resulting compound to a saponification reaction, is used. However, because rosin can be produced from only pine tree the supply of rosin is insufficient for the demand according to development of industries. There is no adequate substitute for rosin as yet, although much study for synthetic sizing agents by using petrochemicals are proposed and have been conducted. As a result of studies, a substance, which is obtained by a co-polymerization reaction of cyclopentadienes with $\alpha,\beta$-unsaturated carbonyl compound and aliphatic conjugated diene compound under heating, and then saponifying the co-polymer with alkali hydroxide, is proposed as a sizing agent having good sizing effect (Japanese Pat. laid open No. 39706/1973).

The inventor in the present invention has taken notice that the compound of the formula (II), which is mentioned in said Japanese patent laid open No. 39706/1973 as an effective component of sizing agents and for which the preparation thereof is described in Japanese Pat. laid open No. 49753/1973, is obtained from petrochemical especially from unused fraction of petrochemicals and the compound of the formula (II) possessing other characteristics than those of other synthetic sizing agent. Namely, the compound of the formula (II) is a mixture of several kinds of specific lower molecular compounds and is in form of resin, though synthetic sizing agent in a form of resin developed before is a polymer consisting of many kind of molecular weight and can not be represented by specific chemical structure. For example, petroleum resin, which is a polymer of alkylstyrenes, consists of innumerable kinds of chemical structure and a mixture of innumerable kinds of compounds. Accordingly, it is impossible to prepare only compounds suitable for sizing agent from the petroleum resin by changing it into the corresponding resin acid by introducing carboxy group, since compounds not suitable for sizing agent are also produced at the same time. The inventor in the present invention applied various chemical treatments to the compound of the formula (II) and conducted comparison tests with respect to sizing effect thereof based on his idea that a very effective sizing agent would be obtained by applying suitable treatment for sizing effect to the compound of the formula (II). As a result, it has been found that the sizing effect of a specific compound, which is obtained by hydrogenating the compound of the formula (II) to saturate an unsaturated group in the ring of it and then saponifying the resulting compound with alkali hydroxide, is unexpectedly improved although other investigated compounds are useless. The hydrogenation reaction is sometimes used in order to stabilize compounds possessing unsaturated group(s) by saturation of the unsaturated group(s) and it is known that the hydrogenation reaction can be applicable for known sizing agents. For example, hydrogenation reaction of rosin gives a stabilized pale resin and it is used for uses needing resistance against thermal and chemical degradation, etc. in quality, and the stabilized rosin is suitable for drawing paper and special paper since when the stabilized rosin is used as a sizing agent, obtained paper has resistance against yellowing.

However, it is an unexpected phenomenon that improved sizing effect other than stability comes out by the hydrogenation reaction of the compound of the formula (II). It is not clear for even the inventor the sizing effect of the compound of the formula (II) is increased by subjecting it hydrogenation reaction and hydrolysis or saponification reaction, but it seems to be based on the special feature of the compound of the formula (II).

The compound of the formula (II) and be prepared by subjecting $\alpha,\beta$-unsaturated nitrile compound and cyclopentadiene or methylcyclopentadiene to Diels-Alder addition reaction to produce an addition compound consisting of 1 molecule of the former and 2 molecule of the later and then subjecting the addition compound and an aliphatic conjugated diene compound to Diels-Alder addition reaction.

Suitable $\alpha,\beta$-unsaturated nitrile compounds include, for example, acrylonitrile, methacrylonitrile and the like. As cyclopentadiene can be obtained by thermal decomposition of dicyclopentadiene, cyclopentadiene used in the reaction can be generated in the reaction vessel by placing dicyclopentadiene in the reaction vessel and then heating it. Methylcyclopentadiene can be also used similar to cyclopentadiene.

Suitable aliphatic conjugated diene compounds include, for example, 1,3-butadiene, isoprene, 1,3-pentadiene, 2,4-hexadiene, 1,3-butadiene substituted with methyl such as 2-methyl-1,3-pentadiene, and the like.

The above-mentioned unsaturated compounds easily give various kind of adducts and polymers, since the unsaturated compounds are very sensitive to polymerization and oxidation reactions and their addition reactions do not stop under heating. Accordingly, in order to keep the purity of the compound of the formula (II), it is necessary to synthesize it by isolating the produced objective intermediate at each stage under conditions controlling the formation of by-product, for example, temperatures below 190°C. Especially, when the compound of the formula (II) is collected as a distillate after the aliphatic conjugated diene compound is reacted under pressure, a great amount of by-product is contained in it. When the compound of the formula (II) contains a great amount of by-product, sizing effect of the object compound prepared from the compound of the formula (II) becomes lower. Accordingly, preferable compound of the formula (II) in a form of resin used in the present invention is purified one by distillation under reduced pressure. Even if the compound of the formula (II) is crude, as long as the compound of the formula (II) is a main product, sizing effect is improved by hydrogenation. Thus obtained nitrile compound (II), in the present invention, is selectively hydrogenated to give the saturated nitrile compound (III), and then the latter is hydrolyzed or saponified to give the saturated carboxylic acid (I) or the water soluble salt therefore.

While, the inventor has investigated other suitable starting compounds and paid attention to the following process;

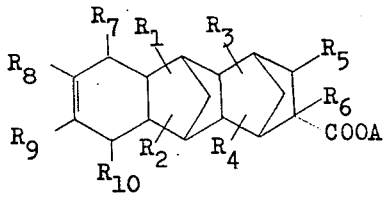

(II')

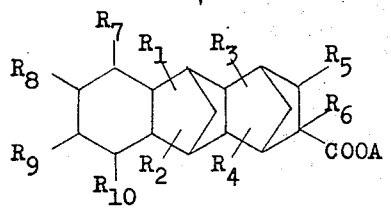

(III')

the compound (III)

wherein $R_1$, $R_2$, $R_3$, $R_4$, $R_5$, $R_6$, $R_7$, $R_8$, $R_9$, and $R_{10}$ are each as defined above and A is hydrogen, alkali metal or alkyl. However, the process using the said starting compound (II') is not useful in the industrial meaning according to the following reasons.

While, the compound (II') wherein A is an alkyl group should be prepared by addition with cyclopentadiene and methl acrylate, methyl methacrylate, etc., these monomers have less reactivity with cyclopentadiene than acrylonitrile and are much more expensive. Moreover, when the compound (III') is subjected to hydrolysis, an alcohol compound is eliminated to decrease the molecular weight. Therefore, the manufacturing process via carboxy ester compound as an intermediate is quite uneconomical.

Further, when the compound (II') wherein A is hydrogen is prepared by an addition reaction with cyclopentadiene and acrylic acid, methacrylic acid, etc., acylation reaction occurs between the carboxy group and the unsaturated bond to give a great amount of ester derivative other than the usual Diels-Alder reaction as is described in the reference 1.

Further, the compound (II') wherein A is hydrogen can be also prepared by hydrolyzing the starting compound (II) of the present invention. However, this process is industrially quite troublesome as is described in the reference 2. Still further, the compound (II') wherein A is alkali metal has a high melting point. Therefore, the compound should be treated as a soap solution for hydrogenation using a large amount of water, which is a difficult method for an industrial manufacturing process, since blowing of hydrogen gas is quite difficult. The inventor has attempted the reaction in the presence of Raney-nickel, but could not obtain the hydrogenated compound. The inventor in the present invention has been studying to save the said situation and after various studies, has found that the easily obtainable unsaturated polycyclic nitrile type intermediate of the formula (II) is a most suitable compound, since the molecular weight is economically increasing through the present reaction process. The compound of the formula (III) obtained by hydrogenating the starting compound of the formula (II) is novel, and therefore, the preparation method for the compound of the formula (III) is of course unknown.

The hydrogenation reaction applicable for the present invention is limited to the specific methods and conditions which hydrogenate only the double bond in the ring of the compound of the formula (II). When the unsaturated group other than double bond in the ring of the compound of the formula (II), i.e. cyano group is hydrogenated to the corresponding aminomethyl methyl group in the hydrogenation reaction, it is impossible to use them as a sizing agent for paper manufacture, since an aminomethyl group can not be converted into the corresponding carboxylic acid or carboxylic acid salt by hydrolysis, saponification or other industrial process. Accordingly, the hydrogenation reaction is limited to one which hydrogenates selectively the double bond in the ring, but does not hydrogenates the triple bond between carbon atom and nitrogen atom. Therefore, the said selective hydrogenation reaction is applied to the starting compound (II) in the present invention.

When the hydrogenation reaction is conducted under conventional conditions, the cyano group is also reduced as described above and produces a compound having an aminometyl group and/or complicated polyamine which gives bad influence an sizing effect. Namely, when the said by-product is contained in the object compound, it follows that compounds having opposite electric charge to each other coexist, and therefore, even a small amount of the said by-product causes difficulty if it is used as a sizing agent. An industrially preferable method for preparing the object compound by a method for saturating only a double bond in the ring without changing the cyano group of the starting compound of the formula (II) has been found by the inventor after various studies. Namely, the present process is completed by finding out the facts that when the starting compound of the formula (II) is hydrogenated in the presence of noble metal for catalytic reduction with alcohol or without any solvent, it is possible to hydrogenate only the unsaturated group in the ring without changing the cyano group.

According to the present process, selective hydrogenation reaction of the starting compound of the formula (II) is carried out first. The hydrogenation reaction applied in the present invention is carried out by using noble metal for catalytic reduction such as palladium catalyst, platinum catalyst, rhodium catalyst, etc. with alcohol or without any solvent. The hydrogenation reaction is preferably carried out without solvent industrially, and in this case, the reaction pressure is 1 to 5 atmospheric pressure and more preferable reaction pressure is 1 atmospheric pressure, and the reaction temperature is room temperature to heating and more preferable reaction temperature to heating below 220°C, especially 100° to 180°C. The reaction is preferably carried out by introducing hydrogen gas until desired conversion of hydrogenation is attained and by contacting the reaction mixture with hydrogen gas sufficiently under stirring. When the reaction is desired to be completed in a short time, the reaction is desired to be completed in a short time, the reaction is preferably carried out in the presence of alcohol. The reaction is carried out under 1 to 100 atmospheric pressure and more preferably under 5 to 30 atmospheric pressure. Further, the reaction is usually carried out at room temperature to under heating such as below 220°C, for example around 150°C.

Suitable alcohols include, for example, lower alcohol such as methanol, ethanol, propanol, isopropanol and the like, and more than 90 percent conversion of hydrogenation can be attained without hydrogenation of the cyano group by using the alcohol. Polyhydric alcohol such as ethylene glycol, diethylene glycol and the like can be also used as the alcohol alone or along with other alcohol. The hydrogenation reaction proceeds in good yield under afore-mentioned conditions, but it is economically and safely recommended to control the reaction velocity in order to keep selectivity of the hydrogenation and it is concretely recommendable that the reaction is carried out at atmospheric pressure in a reaction vessel such as batch type or continuous type vessel of fluid bed or fixed bed in which hydrogen gas can be easily contacted with the reaction mixture without any solvent. When the hydrogenation reaction is carried out under other usual conditions, for example, using nickel-type, cobalt-type, copper-type or chrome-type catalyst in the presence of hydrocarbon or other solvent, not only the unsaturated group in the ring is hydrogenated but also the cyano group is also hydrogenated partially or completely amino compounds, which give bad influence for sizing effect, are produced. Sizing effect is of course enhanced in accordance with elevation of of hydrogenation ratio, and sizing effect is improved very much even if the unhydrogenated compound is remains in the reaction mixture.

Thus obtained saturated polycyclic nitrile compound of the formula (III) is novel, and this can be converted to the corresponding water soluble salt of the saturated polycyclic carboxylic acid of the formula (I) possessing excellent sizing effect by saponification in a conventional method.

The hydrolysis or saponification reaction is conducted in order to convert to carboxylic acid or carboxylic acid water soluble salt.

Examples of the water soluble salt are alkali metal salt such as lithium salt., sodium salt, potassium salt; ammonium salt; alkyl amine salt; alkanol amine salt, and the like.

More concrete preparation methods and improvement of the sizing effect in the present invention is illustrated by the following specific preparation of the starting compound and examples, in which all percentages are in weight.

PREPARATION OF THE STARTING COMPOUND

1. Preparation of Crude Unsaturated Polycyclic Nitrile Compound

A mixture of one mole of acrylonitrile and ½ mole of dicyclopentadiene was heated at 170° to 180°C and then the reaction mixture was rectified to give 5-cyanobicyclo[2,2,1] heptene-2 which is an equivalent addition compound of acrylonitrile and cyclopentadiene. Thus obtained compound (145g) was heated at 170°C, and to this was added dicyclopentadiene (40g) over 5 hours under stirring and the mixture was further stirred for 1 hour. After the reaction was over, unreacted compounds were distilled off up to 120°C/60 mmHg to give addition product (74g) as a residue possessing the chemical structure of the formula:

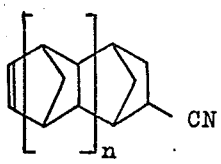

[a]

It is confirmed by gas chromatography that the addition product consists of 87.7 % of a main compound of the formula [a] wherein n is tricyclopentadiene, 1, 2.9 % of tricyclopntadiene, 7.0 % of a compound of the formula [a] wherein n is 2 and 2.4 % of polymer. Thus obtained addition product (70g) was heated at 170°C and to this was added isoprene at the rate of 3 g/hour for 20 hours. Then, unreacted compounds were distilled off to give pale yellow balsamic substance (40.4g). It is confirmed and identified by gas chromatography, elementary analysis, measurement of molecular weight and infrared absorption spectrum that the balsamic substance consists of 84.0 % of a compound of the formula:

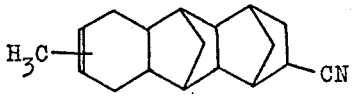

[b]

, 2.7 % of a compound of the formula:

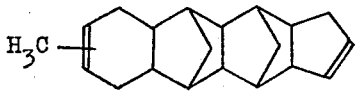

[c]

, 10.1 % of a mixture of a compound of the formula:

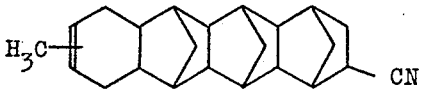

[d]

and a compound of the formula [a] wherein n is more than 2 and pitch polymer. Thus obtained balsamic substance is called crude starting nitrile compound for short hereinafter.

2. Refinication of the Crude Starting Nitrile Compound

The crude starting nitrile compound (500g) prepared by the above operation was distilled by using a high vacuum distiller with one liter volume of flask and 10 cm of Wigly type rectifying column, and main distillate (475g) was collected under 180° to 183°C/0.3mmHg. It is found by the afore-mentioned analysis that the main distillate consists of 98.5 % of a compound of the formula [b] and a mixture which seemed to be compounds of the formula [a] and tricyclopentadiene. Thus obtained colorless balsamic distillate is called refined starting nitrile compound for short hereinafter.

REFERENCE 1

An equlmolar amount of acrylic acid and CPD were mixed and charged in an autoclave. The reaction mixture was heated at 180°C for 2 hours. After reaction was over, 75.2% of Diels-Alder type adduct

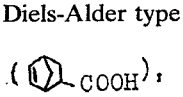

19.3% of ester derivative

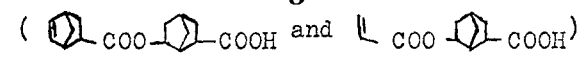

and pitch like polymer, and 5% of unreacted materials were isolated. These compounds were also detected by high-speed liquid chromatography.

Then thus obtained adduct was further reacted with CPD under heating at 170°C for 3 hours. The consecutive reaction was conducted to keep the mild condition. However, only 13.9% of the expected adduct

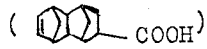

was obtained and 12.7% of acylated ester compound was included in the product. Other components in the product were the starting materials.

REFERENCE 2

Preparation of Unsaturated Polycyclic Carboxylic Acid

Each of the crude starting nitrile compound and the refined starting nitrile compound obtained by the above operation was separately placed in each autoclave, and after inner gas was replaced with nitrogen gas, 1.5 equivalent of 10 % potassium hydroxide aqueous solution was added to each autoclave. Each was stirred for 2 hours at 200°C. After cooling, generated ammonia gas was discharged from each of the reaction mixtures, and each of the reaction mixtures was put into a separating funnel. To each of them were added about the same amount of xylene and water, and xylene layer was separated from each of them after shaking. To each of the remaining pale yellow and transparent aqueous soap solution was added the same amount of xylene, and each of them acidified by adding sufficient amount of hydrochloric acid and then each was well shaken. Then, each precipitated resin was dissolved in xylene and each aqueous layer was removed, and xylene layer was washed with water untl each layer becomes neutral. After drying each xylene layer, xylene was removed under reduced pressure. Brown transparent resin was obtained as a residue from the crude starting nitrile compound, and this brown resin is called crude starting carboxylic acid compound for short hereinafter. On the other hand, pale yellow transparent resin was obtained from the refined starting nitrile compound, and this resin is called refined starting carboxylic acid compound for short hereinafter. These products are the corresponding unsaturated polycyclic monocarboxylic acid, and the properties of these products are the following.

| | Crude product | Refined product |
|---|---|---|
| Softening point | 75°C | 66°C |
| Acid value | 196.3 | 201.1 |
| Bromine value | — | 58.5 |

The bromine value is determined by calculation of the amount of bromine used only in the addition reaction which is by deducting bromine used in substitution reaction from bromine totally used with titration.

EXAMPLE 1

1. Hydrogenation of Refined Starting Nitrile Compound

The refined starting nitrile compound (30g), ethanol (200g) and 5 % palladium carbon were placed in a one liter autoclave, and the inner air was replaced with hydrogen gas, and then the mixture was hydrogenated under the conditions shown in the following Table 1 under stirring. After the reaction was over, the reaction mixture was cooled, and the catalyst was filtered off. Ethanol was distilled off from the filtrate to give colourless transparent balsam.

2. Preparation of Sizing Agent by Saponification of the Hydrogenated Compound The three hydrogenated compounds obtained in the above hydrogenation reaction were saponified in an autoclave with potassium hydroxide in the similar manner to that of the preparation of unsaturated polycyclic carboxylic acid. Each saponified product was diluted with water to give 20 % soap solution, each of which is called size (1-1), size (1-2) and size (1-3) respectively for short hereinafer.

The hydrogenation conditions used in this example and the properties of the products are shown in the following Table 1, wherein the products mean the free carboxylic acid obtained by treating a part of the above obtained sizing agent with hydrochloric acid in xylene in separating funnel, and collecting the xylene solution including the products, and then removing xylene.

(Table 1)

| Experiment No. | | (1-1) | (1-2) | (1-3) |
|---|---|---|---|---|
| Hydrogenation conditions | Catalyst amount (g) | 0.3 | 0.3 | 0.1 |
| | Hydrogen pressure ($kg/cm^2$) | 80 | 30 | 20 |
| | Temperature(°C) | 100 | 80 | 60 |
| | Reaction time (hour) | 1 | 0.5 | 0.5 |
| Properties of product | Softening point (°C) | 63.0 | 64.5 | 65.5 |
| | Acid value | 198.7 | 199.5 | 200.8 |
| | Bromine value | 31.0 | 52.1 | 55.3 |
| The rate of hydrogenation (%) | | 47.0 | 11.0 | 5.5 |

3. Sizing Effect Test

In order to compare sizing effect of the sizing agents obtained as above, paper was prepared by TAPPI type standard sheet machine for test. L-BKP pulp manufactured by Sanyokokusaku Pulp Co. was beated to 32°SR, and then adjusted to concentration of 1 % pulp slurry. To the slurry was added 5 % aqueous solution of each sizing agent so as to adjust in an amount of 0.5 % based on the dried pulp caluclated as solids.

(Hereinafter, weight percent of other additions means weight percent of the additions as solid based on the weight of the dried pulp.)

After agitating, was further added 2.5 % of aluminum sulfate hydrate and the mixture was stirred. From thus obtained stock, paper was prepared in to a sheet by above mentioned test machine. After pressing, it was dried for 5 minutes at the temperature shown in the Table 2 to give paper web for sizing effect test. Each 6 sheets of paper were prepared in accordance with the kinds of sizing agents and change of drying temperature. Sizing degree of thus obtained paper (60± 1 $g/m^2$) was measured according to stockight method, and each test was conducted per 6 sheets of paper. The results, which are average results of 6 sheets of paper, were shown in the following Table 2.

(Table 2)

| Kind of sizing agent | | | Sizing degree (second) | |
|---|---|---|---|---|
| | Name of sizing agent | The rate of hydrogenation(%) | Drying temperature 80°C | Drying temperature 110°C |
| Sizing agent in the present invention | Size (2-1) | 47.0 | 27.1 | 13.0 |
| | Size(2-2) | 11.0 | 24.3 | 10.1 |
| | Size (2-3) | 5.5 | 22.0 | 9.7 |
| Comparison sizing agent | Unhydrogenated sizing agent* | 0 | 17.1 | 6.1 |

*Note: Unhydrogenated sizing agent was obtained by saponifying the refined starting carboxylic acid compound with potassium hydroxide.

It is clear from the above Table 2 that sizing effect of the sizing agents in the present invention is clearly improved even with 5 % hydrogenation ratio and sizing effect is improved in accordance with increasing of hydrogenation ratio.

EXAMPLE 2

The refined starting nitrile compound (150g) and 5 % palladium-carbon (0.75g) were placed in a 350ml vessel possessing bubble generating device, and the temperature of the mixture was elevated to 150°C under stirring. To the mixture was introduced hydrogen gas through bubbling nozzle at the rate of 30 ml/second with generating many bubbles for 20 hours at the same temperature under sufficient stirring. After the reaction was over, the catalyst was filtered off from the hot reaction mixture to give pale yellow transparent balsam of saturated polycyclic nitrile compound (148.0g). It is confirmed that bromine value of the product is 5.8 and 92.7 % of unsaturated group in the ring was hydrogenated, while amine value of the product is O and the cyano group is not changed at all.

EXAMPLE 3

The refined starting nitrile compound (150g), 5 % palladium carbon (0.75g) and ethanol (100g) were placed in a one liter autoclave, and the inner pressure was elevated to 10 atmospheric pressure, and then the hydrogenation reaction was carried out for 7 hours at 120°C under stirring. During the hydrogenation, the inner pressure was kept at 5 to 10 atmospheric pressure by introducing hydrogen gas continuously. After the reaction was over, the reaction mixture was cooled, and then the catalyst was filtered off by using glass filter. Ethanol was distilled off from the filtrate to give pale yellow transparent balsam of saturated polycyclic nitrile compound (148.2g). It is confirmed that bromine value of the product is 4.6 and 94.2 % of the unsaturated group in the ring is hydrogenated, while amine value of the product is O and the amino group can not be detected.

EXAMPLE 4

This hydrogenation reaction was carried out by using similar manner to that of example 3 excepting that methanol (150g) was used instead of ethanol (100g) and as hydrogenation time and temperature, 10 hours at 100°C instead of 7 hours at 120°C were applied to give pale yellow transparent balsam of saturated polycyclic nitrile compound (149.2g). Bromine vaue of the product is 20.6 and 74.2 % of the unsaturated group in the ring was hydrogenated, while amino group can not be detected.

EXAMPLE 5

The refined starting nitrile compound (150g), 2 % platinum-carbon (0.75g) and ethanol (150g) were placed in a one liter autoclave, and the inner pressure was elevated to 15 atmospheric pressure, and then the hydrogenation reaction was carried out for 5 hours at 100°C under stirring. During the hydrogenation, the inner pressure was kept at 10 to 15 atmospheric pressure by introducing hydrogen gas continuously. After the reaction was over, the reaction mixture was cooled, and then the catalyst was filtered off by using glass filter. Ethanol was distilled off from the filtrate to give pale yellow transparent balsam of saturated polycyclic nitrile compound (147.9g). Bromine value of the product is 10.3 and 87.1 % of the unsaturated group in the ring was hydrogenated, while amine value of the product is 0 and cyano group was not changed at all.

EXAMPLE 6

This hydrogenation reaction was carried out by using similar method to that of Example 2 excepting that the crude starting nitirle compound (150g) and 2 % rhodium-carbon (0.75g) were used instead of the refined starting nitrile compound (150g) and 5 % palladium-carbon (0.75g) to give pale yellow transparenT balsam of saturated polycyclic nitrle compound (148.0g). Bromine value of the product is 8.1 and 89.9 % of the unsaturated group in the ring was hydrogenated, while amine value of the product is 0 and hydrogenation of the cyano group does not occur.

EXAMPLE 7

Each saturated polycyclic nitrile compound obtained in the above examples 2 to 6 and equivalent potassium hydroxide based on the each acid value were placed in a one liter autoclave, and the concentration of each mixture was adjusted to 20 % by adding water, and then each mixture was saponified for 1 hour at 200°C under stirring to give the corresponding aqueous solution of potassium saturated polycyclic carboxylate.

EXAMPLE 8

A used catalyst (5% Pd-C 0.75g) that was filtered in Example 2 was collected as a pasty substance. This substance was added to the new starting compound i.e. refined starting nitrile compound (150g) and the reaction was conducted in a same manner as Example 2 (reaction time was 6 hours). These processes were repeated for each new starting compound, and saturated polycyclic nitrile compounds were obtained as shown in the following Table 3.

(Table 3)

| repeated No. | 1 | 2 | 3 | 4 | 5 | 6 | 7 | 8 | 9 | 10 |
|---|---|---|---|---|---|---|---|---|---|---|
| Bromine value of the product | 5.8 | 6.1 | 6.2 | 6.4 | 6.6 | 6.8 | 7.0 | 7.1 | 7.3 | 7.5 |
| Amine value of the product | 0 | 0 | 0 | 0 | 0 | 0 | 0 | 0 | 0 | 0 |
| Hydrogenation ratio | 92.7 | 92.4 | 92.2 | 92.0 | 91.7 | 91.4 | 91.2 | 91.1 | 90.8 | 90.6 |

| repeated No. | 11 | 12 | 13 | 14 | 15 | 16 | 17 | 18 | 19 |
|---|---|---|---|---|---|---|---|---|---|
| Bromine value of the product | 7.6 | 7.8 | 8.0 | 8.0 | 8.3 | 8.4 | 8.7 | 9.0 | 9.2 |
| Amine value of the product | 0 | 0 | 0 | 0 | 0 | 0 | 0 | 0 | 0 |
| Hydrogenation ratio | 90.3 | 90.2 | 89.9 | 89.9 | 89.6 | 89.4 | 89.0 | 88.7 | 88.4 |

$$\text{Hydrogenation ratio} = \frac{\text{Bromine value of the standing compound (79.5)} - \text{Bromine value of the product}}{\text{Bromine value of the starting compound (79.5)}}$$

It is clear from the above Table 3 that noble metal for catalytic reduction of the present invention has a long life and it can be repeatedly used to give the stable hydrogenation effect.

REFERENCE 3

This hydrogenation reaction was carried out by using the similar manner to that of Example 5 excepting that tetrahydrofuran (150g) was used instead of ethanol (100g) and as hydrogenation time and temperature, 5 hours and 150°C were applied to give pale yellow transparent balsam (147.9g). Bromine value of the product is 36.4 and the rate of hydrogenation is 54.5 %, but amine value is 7.5.

REFERENCE 4

This hydrogenation reaction was carried out by using the similar manner to that of Example 5 excepting that nickel-diatomaceous earth catalyst (Nickel containing 51 %: 1.5g) and ethanol (150g) were used instead of 5 % palladium-carbon (0.75g) and ethanol (100g) and as hydrogenation time and temperature, 4 hours and 120°C were applied to give pale yellow transparent balsam (148.2g). Bromine value of the product is 51.7 and the rate of hydrogenation is 35.4 %, but amine value is 86.6.

REFERENCE 5

Ni-diatomaceous earth (Ni 51%) 1.5g was placed instead of palladium carbon in Example 2. The reaction mixture was heated at 170°–180°C and hydrogen gas was blown for 3.5 hours. Bromine value of the product was 58.3 and the hydrogenation ratio was 26.7%. On the other hand, 18% of the product was an amiinomethyl derivative (amine value was 39.2).

REFERENCE 6

Cu-Cr-O catalyst 5g (Nikki Chemical Co., Ltd., N-203) was added to 100g of refined starting nitrile compound. The reaction mixture was charged into an autoclave and hydrogen gas was blown (5kg/cm$^2$) and then was heated at 130°C for 6 hours with stirring. However, hydrogen gas was not substantially observed. Therefore, hydrogenated compound was not obtained.

TEST 1

Sizing Effect Test:

Sizing degree was measured according to the same method as described in the above Example 1. The results are shown in the following Table 4.

In order to compare sizing effect, the same sizing tests with respect to the comparison agent Nos. 1 to 4 were also conducted.

a. Comparison agent No. 1: Aqueous solution of potassium unsaturated polycyclic carboxylate obtained by saponificaton of the refined starting nitrile compound.
b. Comparison agent No. 2: Aqueous solution of potassium salt of chinese gum rosin X.
c. Comparison agent No. 3: Aqueous solution of potassium salt of hydrogenated resin produced by Hercules Inc. U.S.A.
d. Comparison agent No. 4: Aqueous solution of potassium salt of maleic modified (5%) rosin which is called fortified rosin size.

Sizing agents in the present invention used for comparison tests are as follows:

a. Size No. 1: Aqueous solution of potassium saturated polycyclic carboxylate prepared by Example 7 using hydrogenated product of Example 2.
b. Size No. 2: Aqueous solution of potassium saturated polycyclic carboxylate prepared by Example 7 using hydrogenated product of Example 3.
c. Size No. 3: Aqueous solution of potassium saturated polycyclic carboxylate prepared by Example 7 using hydrogenated product of Example 4.
d. Size No. 4: Aqueous solution of potassium saturated polycyclic carboxylate prepared by Example 7 using hydrogenated product of Example 5.
e. Size 5: Aqueous solution of potassium saturated polycyclic carboxylate prepared by Example 7 using hydrogenated product of Example 6.

(Table 4)

| Sizing agent | Bromine value | The rate of hydrogenation | Sizing degree (second) Dried for 5 minutes at 80°C | Dried for 5 minutes at 110°C |
|---|---|---|---|---|
| Size No. 1 | 5.8 | 92.7 | 46.0 | 24.6 |
| Size No. 2 | 4.6 | 94.2 | 46.5 | 24.5 |
| Size No. 3 | 20.6 | 74.2 | 43.8 | 21.7 |
| Size No. 4 | 10.3 | 87.1 | 45.8 | 23.7 |
| Size No. 5 | 8.1 | 89.9 | 46.2 | 24.2 |
| Comparison agent No.1 | 80.0 | 0 | 21.7 | 9.3 |
| Comparison agent No.2 | — | — | 15.9 | 6.1 |
| Comparison agent No.3 | — | — | 15.3 | 6.5 |
| Comparison agent No.4 | — | — | 31.1 | 13.8 |

TEST 2

Sizing Effect Test

Sizing degree was measured according to the same method as described in the above Example 1 excepting that addition ratio of sizing agent and aluminum sulfate hydrate wherein drying conditions is "for 5 minutes at 80°C". The results are shown in the following Table 5.

(Table 5)

| Sizing agent | Addition ratio (%) Sizing agent | 0.2 | 0.3 | 0.5 | 1.0 |
|---|---|---|---|---|---|
| | Aluminum sulfate hydrate | 1.0 | 1.5 | 2.5 | 4.0 |
| Size No. 1 | | 28.7 (seconds) | 35.4 (sec) | 47.5 (sec) | 56.2 (sec) |
| Size No. 5 | | 23.9 | 32.1 | 46.3 | 55.1 |
| Comparison agent No. 4 | | 12.6 | 20.4 | 31.8 | 48.8 |

TEST 3

Sizing Effect Test

Sizing degree with respect to the size No. 1 in the present invention and the comparison agent NO. 4 were measured according to the method described in the above Example 1 excepting that 10 % or 20 % calcium carbonate based on 100 % of dried pulp was added first before the addition of 0.5 % of the sizing agent an 2.5 % of aluminum sulfate hydrate. The results are shown in the following Table 6.

(Table 6)

| Sizing agent | Addition ratio of calcium carbonate (%) | 0 | 10 | 20 |
|---|---|---|---|---|
| Size No. 1 | | 47.4 (seconds) | 23.7 (seconds) | 8.4 (seconds) |
| Comparison | | | | |

(Table 6)-continued

| Sizing agent | Addition ratio of calcium carbonate (%) | 0 | 10 | 20 |
|---|---|---|---|---|
| agent No. 4 | | 31.9 | 4.1 | 0 |

TEST 4

0.8 % Slurry of pulp produced by Daio paper manufacturing Co. (30°SR) was placed in a one liter Erlenmeyer flask, and to this were added 2.5 % of sizing agent and 5.0 % of aluminum sulfate hydrate based on the dry pulp. Then, the mixture was shaken for 3 minutes, and the mixture was transfered in a 500 ml of measuring cylinder, and then the mixture was kept as it was. After 20 minutes, when the size No. 1 in the present invention was used, any pulp was not froated, while when the comparison agent No. 4 was used, the pulp was froated with foam and 105 ml of clear layer was observed, which foam was difficult to disappear.

TEST 5

The size No. 1 (1.0 %) and the comparison agent No. 4 (1.0 %) were respectively added to pulp prepared by Yatsushiro factory of Jujo paper manufacturing Co. (L-BKP, 28°SR) and each paper was prepared according to the method described in the above test 2. The test results with respect to strength of the each paper are shown in the following Table 7.

(Table 7)

| | Breaking length (km) | Bursting strength |
|---|---|---|
| Size No. 1 | 4.47 | 2.58 |
| Comparison agent No. 4 | 4.06 | 2.37 |

What is claimed is:

1. A compound of the formula:

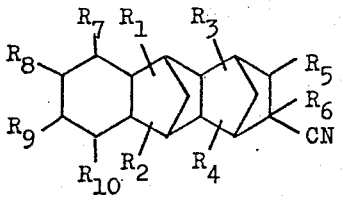

wherein $R_1$, $R_2$, $R_3$, $R_4$, $R_5$, $R_6$, $R_7$, $R_8$, $R_9$ and $R_{10}$ are each hydrogen or methyl.

2. A process for the preparation of a compound of the formula:

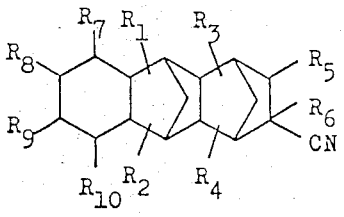

wherein $R_1$, $R_2$, $R_3$, $R_4$, $R_5$, $R_6$, $R_7$, $R_8$, $R_9$ and $R_{10}$ are each hydrogen or methyl, which comprises hydrogenating an unsaturated polycyclic nitrile compound of the general formula:

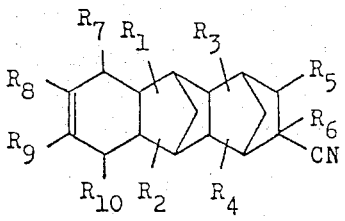

wherein $R_1$, $R_2$, $R_3$, $R_4$, $R_5$, $R_6$, $R_7$, $R_8$, $R_9$ and $R_{10}$ are each as defined above, in the presence of a nobel metal catalyst in the absence of a solvent, at a temperature of from 100° to 180°C and at a pressure of about 1 atmosphere.

* * * * *